US006850069B2

(12) United States Patent
McQueeney et al.

(10) Patent No.: US 6,850,069 B2
(45) Date of Patent: Feb. 1, 2005

(54) COIL ON PLUG CAPACITIVE SIGNAL AMPLIFICATION AND METHOD OF DETERMINING BURN-TIME

(75) Inventors: Kenneth A. McQueeney, Los Gatos, CA (US); Robert R. Bryant, San Jose, CA (US)

(73) Assignee: Snap-On Incorporated, Pleasant Prairie, WI (US)

( * ) Notice: Subject to any disclaimer, the term of this patent is extended or adjusted under 35 U.S.C. 154(b) by 148 days.

(21) Appl. No.: 10/208,197

(22) Filed: Jul. 31, 2002

(65) Prior Publication Data

US 2003/0052687 A1 Mar. 20, 2003

Related U.S. Application Data

(60) Provisional application No. 60/308,580, filed on Jul. 31, 2001.

(51) Int. Cl.[7] ..... F02P 17/00
(52) U.S. Cl. ..... 324/380; 324/399
(58) Field of Search ..... 324/399, 380

(56) References Cited

U.S. PATENT DOCUMENTS

| | | | | |
|---|---|---|---|---|
| 4,804,921 A | | 2/1989 | Putrow et al. | |
| 4,983,882 A | * | 1/1991 | Mayring | 315/59 |
| 5,391,100 A | | 2/1995 | Maruyama et al. | |
| 5,399,972 A | * | 3/1995 | Hnat et al. | 324/399 |
| 5,419,300 A | | 5/1995 | Maruyama et al. | |
| 5,841,283 A | | 11/1998 | Bloemen | |
| 6,396,277 B1 | | 5/2002 | Fong et al. | |

FOREIGN PATENT DOCUMENTS

| | | |
|---|---|---|
| EP | 0477507 A2 | 4/1992 |
| EP | 1088989 A2 | 4/2001 |

OTHER PUBLICATIONS

International Preliminary Examination Report dated Aug. 19, 2003 received in the corresponding PCT Application PCT/US02/24056.

Written Opinion dated Apr. 1, 2003 received in the corresponding PCT Application PCT/US02/24056.

* cited by examiner

*Primary Examiner*—Charles H. Nolan, Jr.
(74) *Attorney, Agent, or Firm*—McDermott Will & Emery LLP

(57) ABSTRACT

A coil-on plug testing apparatus for detecting a weak field output by a shielded coil-on plug ignition and generating an output signal representing an ignition signal includes a capacitive sensor attachable to a coil-on-plug device for detecting an electric field generated by the shielded coil-on plug device during a firing event and generating and outputting a voltage in response thereto. A signal processing circuit electrically coupled to the capacitive sensor is configured to generate an output signal in response to variations in the voltage output by the capacitive sensor in response to a detected electric field. The signal processing circuit comprises an amplifier configured to amplify an output voltage of the capacitive sensor.

19 Claims, 7 Drawing Sheets

COIL ON PLUG CAPACITIVE SIGNAL AMPLIFICATION AND METHOD OF DETERMINING BURN-TIME

CROSS-REFERENCE TO PROVISIONAL APPLICATION

This application claims priority from U.S. Provisional Patent Application Ser. No. 60/308,580 filed Jul. 31, 2001, the entire disclosure of which is incorporated herein by reference.

TECHNICAL FIELD

The disclosure relates to engine analyzers for internal combustion engine direct ignition systems inclusive of coil-on plug or coil-over plug ignitions and, more particularly, to engine analyzers employing ignition signal pickups to detect ignition waveforms in direct ignition systems. The disclosure has particular applicability to automotive engine analysis in which secondary ignition waveforms and the numerical value of segments of such waveforms are displayed for technician evaluation.

BACKGROUND DISCUSSION

Engine analyzers provide mechanics with a tool for accurately checking the performance of the ignition system as a measure of the overall engine performance. Signal detectors ("test probes") are widely used in diagnosing defects and anomalies in internal combustion engines. A test probe is, for example, placed adjacent to a test point such as a ignition coil or ignition wire, and the test probe communicates the signal back to a motor vehicle diagnostic apparatus. Information obtained from the test probe, such as spark plug firing voltage and duration, can help a mechanic determine if a spark plug associated with the ignition coil is functioning properly.

FIG. 1*a* illustrates a capacitive signal detection system. Ignition coil 110 is, essentially, a transformer having a very large turn ratio, typically between 1:50 to 1:100, between the primary and secondary, which transforms the low voltage in a primary winding provided by the sudden opening of the primary current to a high voltage in a secondary winding. Ignition coil 110 is connected to the center or coil terminal (not numbered) of distributor cap 114 by an insulated wire 112. High voltage from the ignition coil 110 is distributed from the coil terminal to side or spark plug terminals of the distributor cap 114 by means of a rotor which distributes the spark to each spark plug terminal at a predetermined timing in a manner known to those skilled in the art and provided in standard technical manuals. The spark voltage provided to the spark plug terminals is, in turn, provided to a corresponding spark plug 122 via insulated wires 118.

At each cylinder, the resulting electric discharge between the spark plug electrodes produces a spark which ignites a fuel-air mixture drawn or forced into the cylinder and compressed to an explosive state, thereby driving a piston in the cylinder to provide power to an attached crankshaft. Analysis of ignition waveforms to evaluate engine performance can be performed by capacitively coupling a capacitive signal pickup 124 to the spark plug wire 118. The capacitive signal pickup 124 is conventionally wrapped around or clipped to wire 118, at one end, and is connected to measuring device 128, at another end, through a wire or coaxial cable 126. The total capacity measured by the pickup 124 is used, in combination with a conventional capacity divider circuit, to determine the wire 118 voltage in a manner known to those skilled in the art.

More recently, ignition systems have evolved to one coil per cylinder or one coil per cylinder pair (a direct ignition system (DIS) or hybrid), and may not have any spark plug wire at all. Such spark ignition systems incorporate an ignition coil over each plug or an ignition coil near each plug as shown, for example, in FIG. 1*b*. High voltage generated at the secondary coil 164 by means of the primary coil 162 and magnetic iron core 160 is routed through the output of the secondary coil through various conductive elements to a conductive output, such as a spring 169, and to the spark plug (not shown) housed within spark plug cap 160. Igniter 168 is a switch that opens after current has been flowing in the coil. This transient develops a large voltage on the primary which is increased by transformation through secondary coil.

FIG. 1*c* shows a coil-over-plug (COP) assembly having ignition coil 140, spark plug 150, and spark plug gap 151. This arrangement prevents application of the conventional technique implemented in FIG. 1*a*, since the high secondary voltage conductor is not as easily accessed as the wire 118 of FIG. 1*a*. For this configuration of COP, a coil-on plug signal detector assembly or sensor 141, such as taught by U.S. Pat. No. 6,396,277, issued on May 28, 2002, and assigned to the present assignee, which is incorporated herein by reference, may be used. The COP sensor 141 includes upper and lower conductive layers (not shown) affixed to and separated by substrate 144. The upper and lower conductive layers act, in one aspect, as a signal detector and as a ground plane. The upper layer is conductively coupled to an external signal analyzer device via wire 152 and the ground plane reflects a portion of the electromagnetic energy generated by the coil, thus serving to attenuate the strength of the signal observed at the signal detector layer to a level easily handled by conventional analyzers. The sensor 141 is clipped to the housing of the ignition coil 140 by a clip 147 attached to sensor housing 148.

In this arrangement, sensor 141 lies within a field of electromagnetic radiation emitted by coil 140 when the coil is transforming primary voltage into high-voltage for use by a spark plug. In operation, low voltage and high current are applied to the primary winding of ignition coil 140 for a predetermined time, and the primary winding generates an electromagnetic field that principally consists of a magnetic field (H). The secondary winding generates an electromagnetic field that is primarily an electric field (E) because it carries high voltage and low current. The lower conductive layer, which is placed adjacent a housing of the coil 140, is brought substantially to ground potential by virtue of such contact. A voltage potential, which could be positive or negative (generally negative for a COP system), is induced or otherwise developed across upper and lower layers 148, and may be measured at or received from the surface of the upper layer or signal detector layer. The voltage observed at the signal detection layer is proportional to the voltage at the terminal end of the secondary coil of coil 140. A signal taken from the signal detection layer may therefore be used in diagnosing ignition spark voltage characteristics, such as spark voltage or burn time, or other problems such as open wires or plugs or fouled or shorted plugs, in a manner known to those skilled in the art.

Despite the advancements realized by present coil-on plug signal detection devices, the sheer variety of ignition coil configurations make it difficult for any one sensor to find universal applicability. For example, the aforementioned sensor 141 may be less than optimal when the coil housing is shielded or otherwise configured to output a distorted or significantly attenuated signal. One example of this occurs in coil-on plug/coil-over plug assemblies bearing an igniter in a ferrous shielded box, which acts a shield for both electric and magnetic fields emanating from the core. Although such coil-on plug/coil-over plug assemblies may be actively shielded, so as to minimize interference with other devices, shielding is broadly considered to include an medium or combinations of mediums that serve to notably attenuate a field output from the coil-on plug assembly, even if such shielding was not itself a design consideration. Therefore, there is a need for a coil-on plug/coil-over plug signal detection device suitable for use in a shielded or low-output ignition coil configurations.

SUMMARY OF THE INVENTION

In one aspect, a coil-on plug testing apparatus is provided for generating an output signal representing an ignition signal. The testing apparatus includes a capacitive sensor for detecting an electric field generated by a coil-on plug device during a firing event, and generating and outputting a voltage in response thereto. The capacitive sensor is placed adjacent to or attached to the coil-on plug device. A signal processing circuit electrically connected to the capacitive sensor generates an output signal in response to variations in the voltage output by the capacitive sensor. The output of the capacitive sensor is then amplified.

In another aspect, a method for determining bum time for a coil-on plug ignition includes disposing a capacitive sensor adjacent a coil-on plug ignition housing, using the capacitive sensor to detect an electric field output by the coil-on plug ignition during a period encompassing at least one firing section, and determining a burn time. The burn time is determined by identifying a firing line equivalent that indicates the occurrence of a firing line and identifying an endpoint of a spark line, and determining the time between the firing line and the endpoint of the spark line.

In yet another aspect, a method for detecting problems associated with a coil-on plug ignition includes disposing a capacitive sensor adjacent a first coil-on plug housing, using the capacitive sensor to detect an electric field output by the coil-on plug ignition during a period encompassing at least one firing section, and identifying at least one of a firing line, spark line, and burn time. These steps are repeated for a second coil-on plug and a comparison is made between at least one of a corresponding firing line, spark line, and burn time identified with respect to the first and second coil-on plugs to determine a relative difference therebetween.

DESCRIPTION OF THE EMBODIMENTS

Figure 2A:
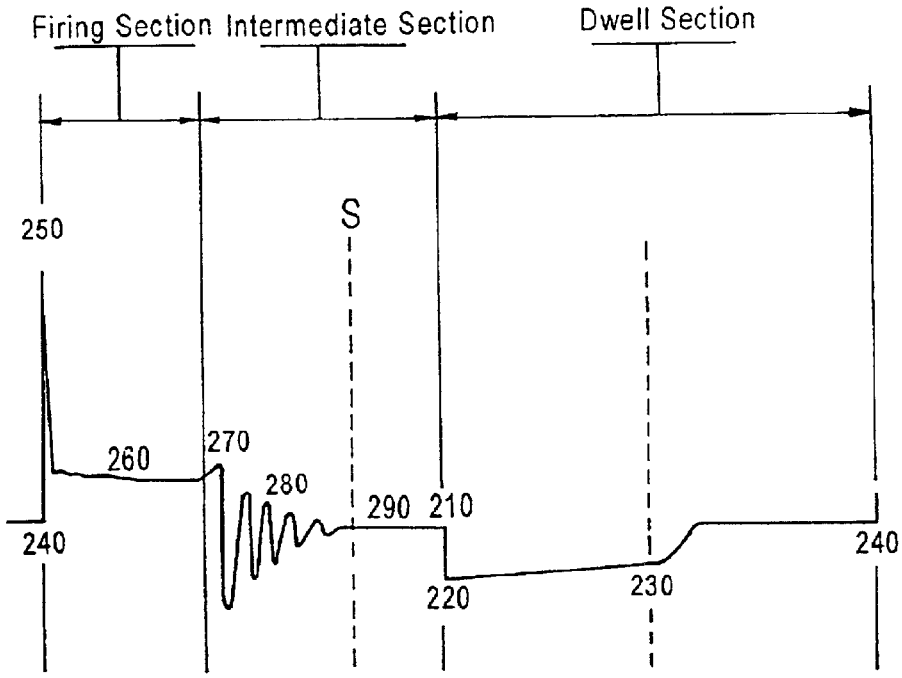
FIGS. 2*a* and 2*b* respectively depict a typical primary ignition waveform and secondary ignition waveform displayed as a function of time.
Figure 2B:
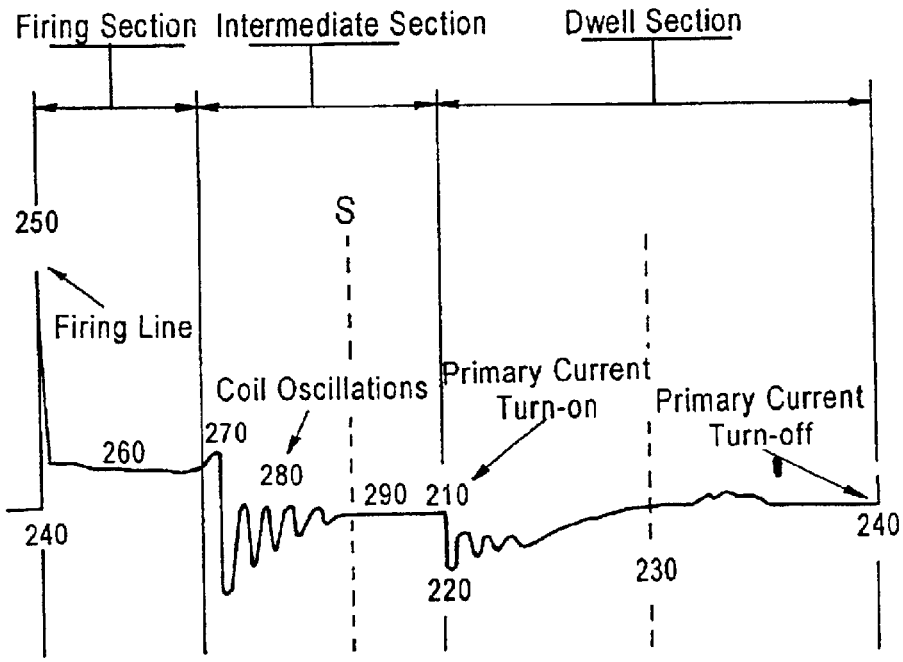

FIGS. 2*a* and 2*b* illustrate, respectively, a typical primary ignition waveform and secondary ignition waveform as a function of time. The waveforms have three basic sections labeled Firing Section, Intermediate Section, and Dwell Section.

Common reference numerals are used in FIGS. 2*a* and 2*b* to represent common events occurring in both the primary and secondary waveforms. At the start S of the waveform, no current flows in the primary ignition circuit. Battery or charging system voltage available at this point generally ranges from approximately 12–15 volts, but is typically between about 12–14 volts. At 210, the primary switching device turns on the primary current to start the "dwell" or "charge" section. At 220, current flows through the primary circuit, establishing a magnetic field in the ignition coil windings. A rise in voltage occurs along 230 indicating that coil saturation is occurring and, on ignition systems that use coil saturation to control coil current, a current hump or voltage ripple appears at this time. The part of the waveform representing primary circuit on-time is between points 210 and 240. Thus, the portion of the signal between points 210 and 240 represents the dwell period or "on-time" of the ignition coil primary current.

The primary switching device terminates the primary current flow at 240, suddenly causing the magnetic field that had built up to collapse and induce a high voltage in the primary winding by self-induction. An even higher voltage is induced, by mutual induction, into the secondary winding, because of a typical 1:50 to 1:100 primary to secondary turns ratio. The secondary voltage is delivered to the spark plug gap, and the spark plug gap is ionized and current arcs across the electrodes to produce a spark 250 (i.e., the "firing line") to initiate combustion and the spark continues for a period of time called the "firing section" or "burn time" 260.

The firing line 250, measured in kilovolts, represents the amount of voltage required to start a spark across the spark plug gap, and is generally between about 3–8 kV. The burn time 260 represents the duration of the spark event, is generally between about 1–3 milliseconds and is inversely related to the firing kV. If the firing kV increases, burn time decreases and vice versa. Over the burn time 260, the discharge voltage across the air gap between spark plug electrodes decreases until the coil energy cannot sustain the spark across the electrodes (see e.g., 270). At 280, an oscillating or "ringing" voltage results from the discharge of the coil and continues until, at 290, the coil energy is dissipated and there is no current flow in the primary circuit.

Figure 3A:
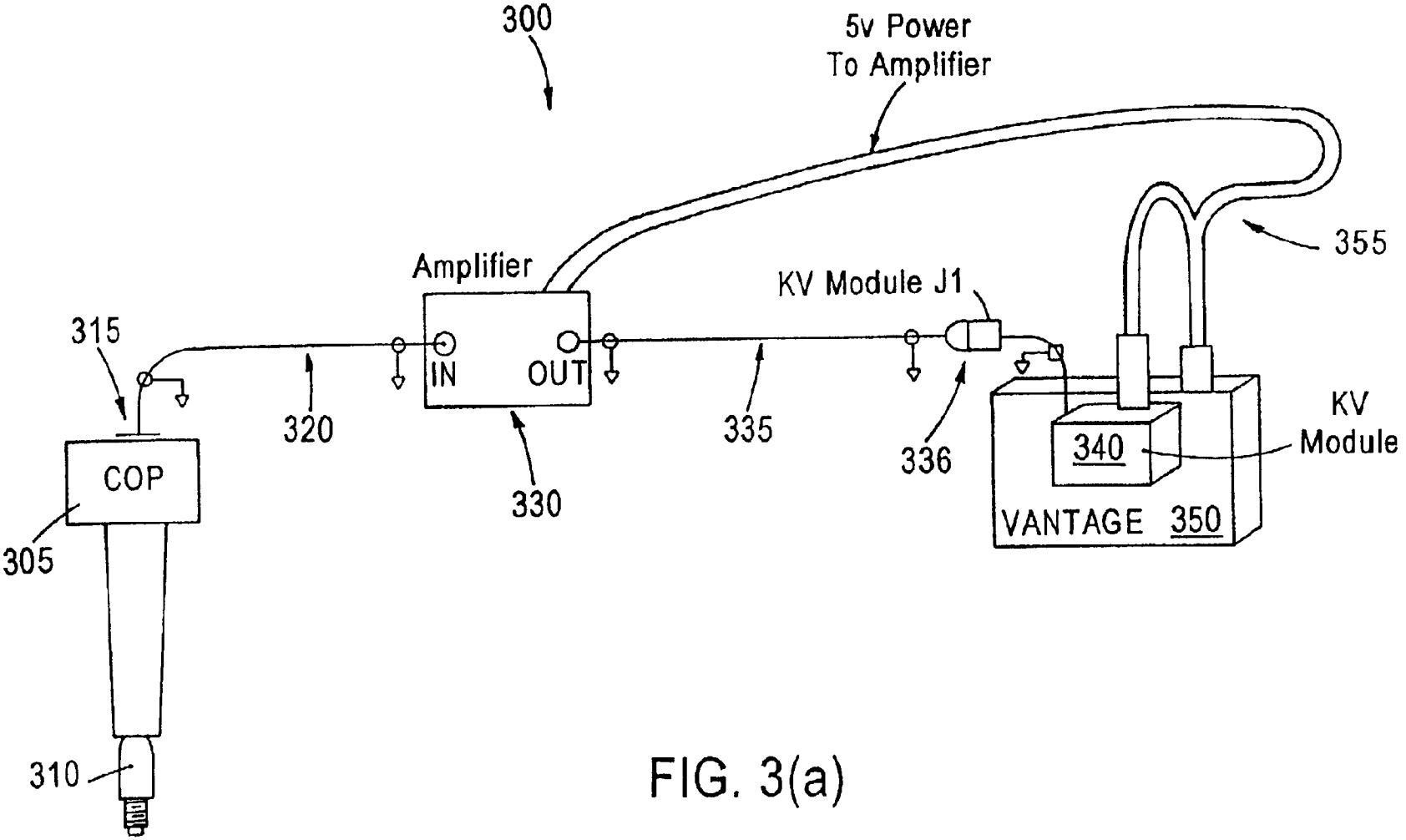
FIGS. 3*a* and 3*b* shows aspects of the disclosed coil-on plug measuring and amplification circuit.
Figure 3B:
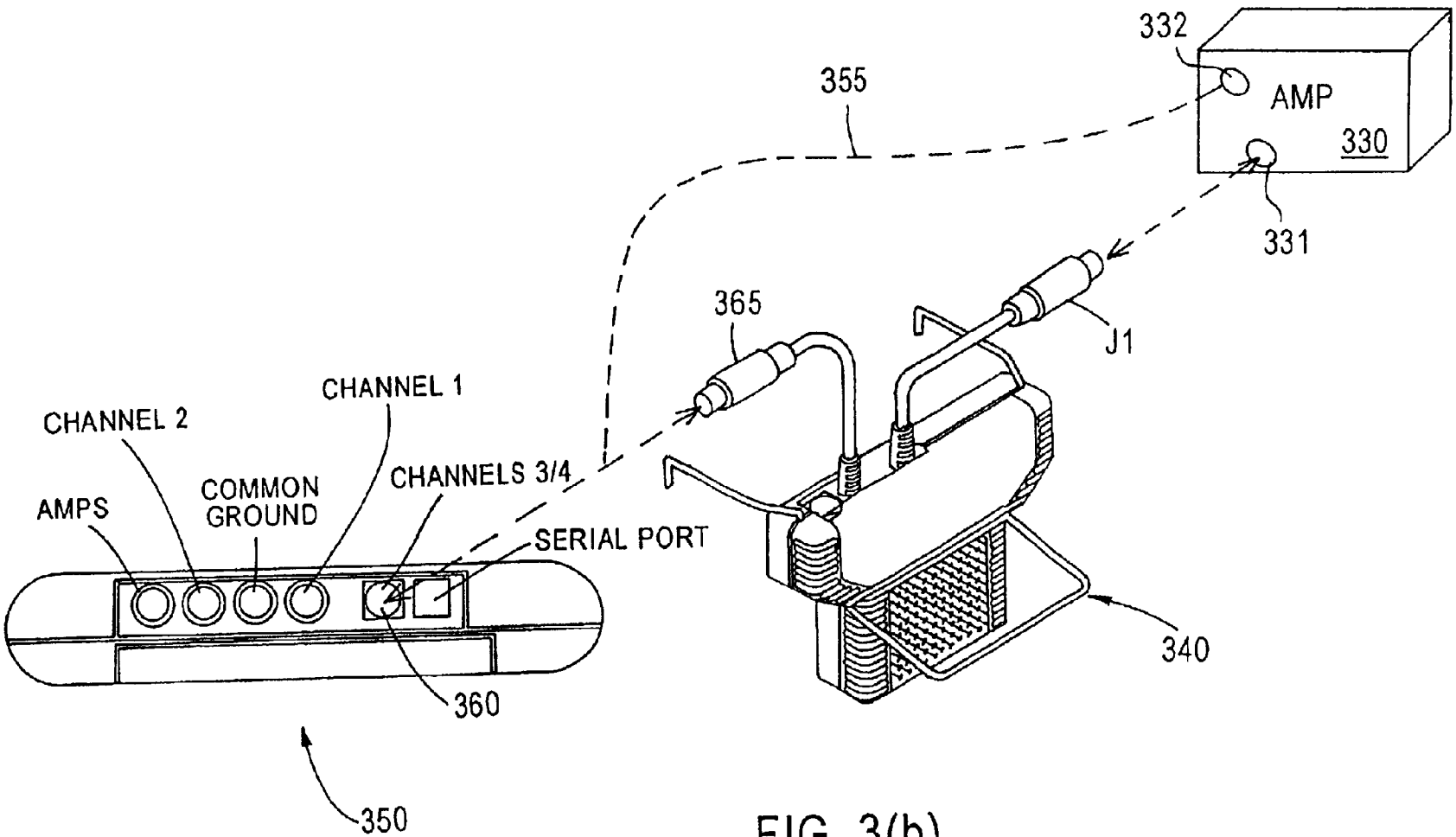

FIG. 3(*a*) illustrates one aspect of a coil-on plug measuring and amplification circuit 300 configured to advantageously condition and modify a weak electromagnetic field output by coil-on plug 305, particularly during a period encompassing the burn time, temporally bounded by the firing line or spark 250 to spark plug 310 and the start of the ringing 290 as shown, for example, in FIG. 2*b*.

Figure 1A:
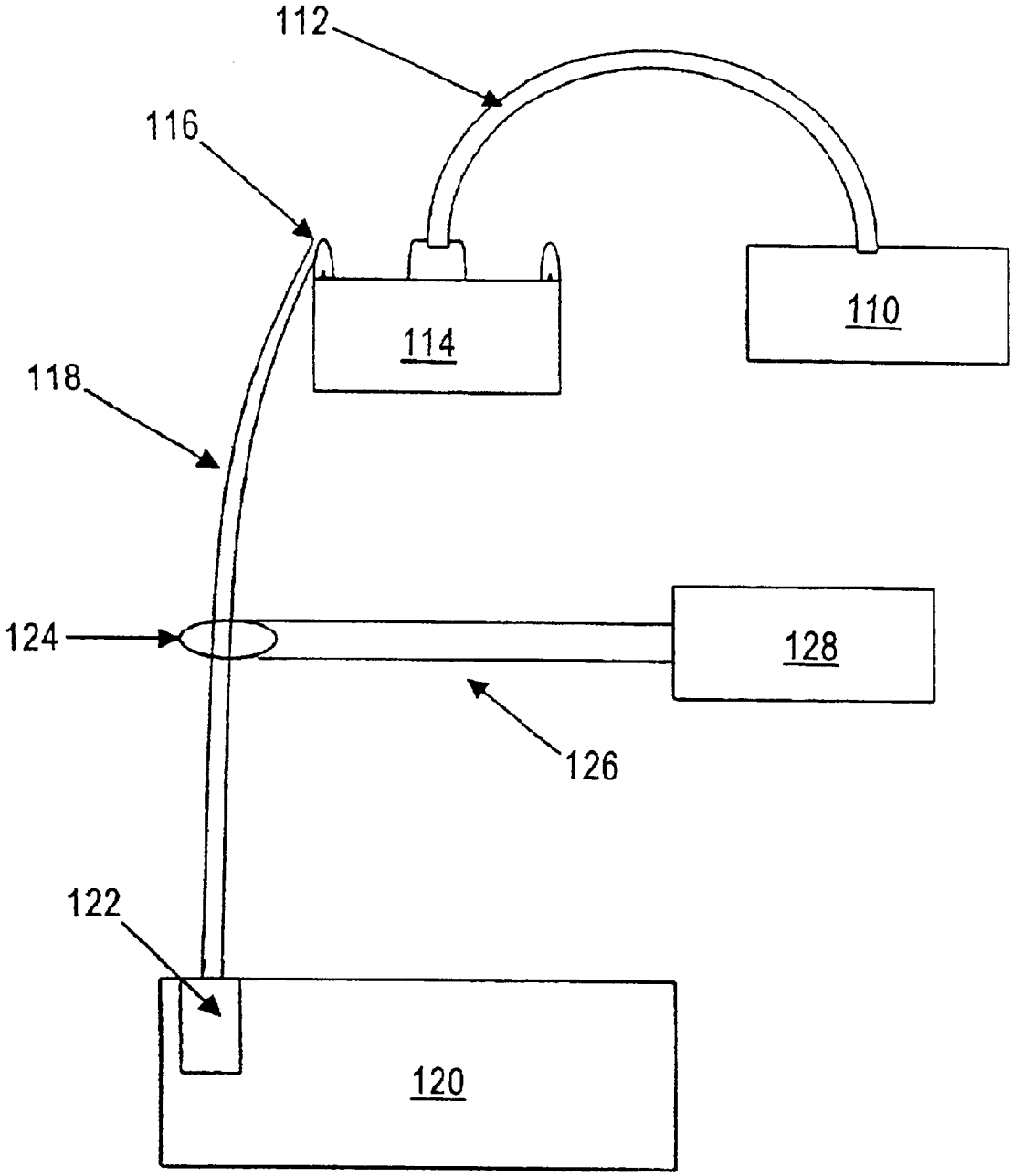
FIG. 1A (PRIOR ART)
FIG. 1*a* depicts a conventional capacitive sensor and circuit for detecting secondary ignition voltages of a distributor-based ignition system.
Figure 1B:
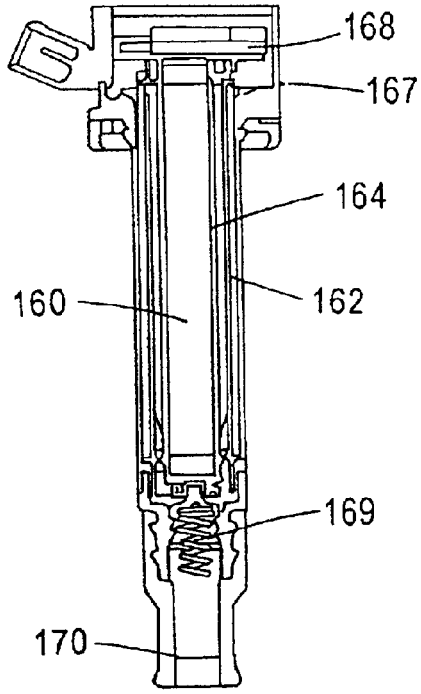
FIGS. 1*b* shows a COP ignition coil with integrated igniter.
Figure 1C:
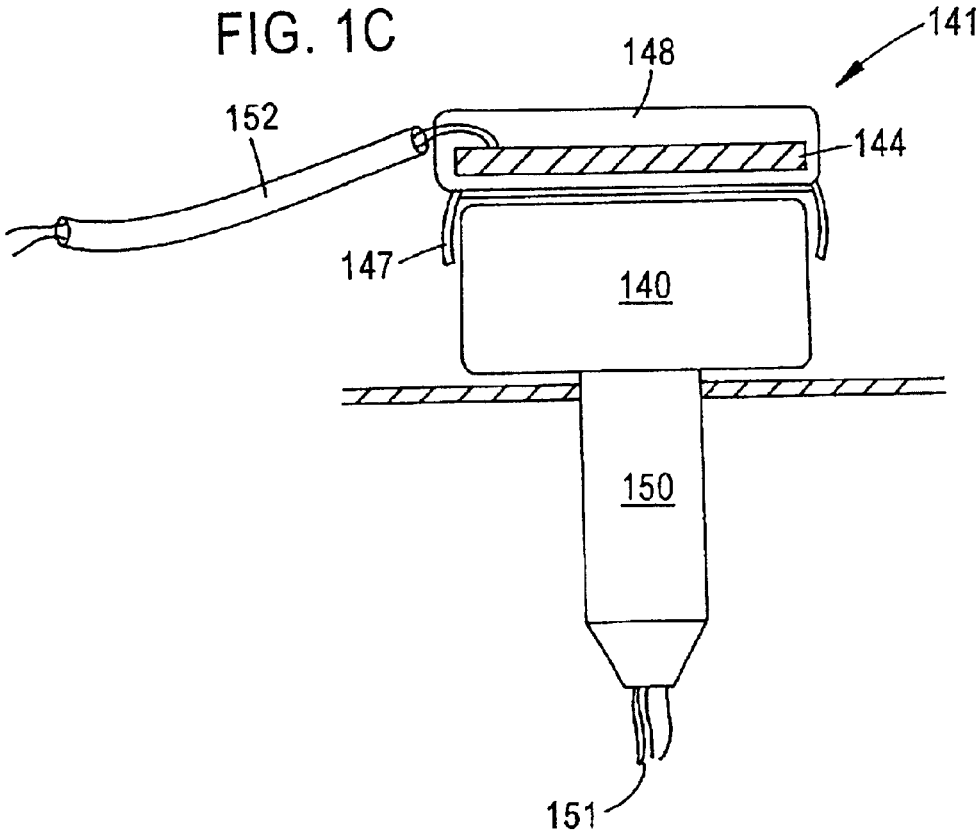
FIG. 1*c* shows another type of COP capacitive sensor placed adjacent a COP.

A technician may simply hold a capacitive sensor in place adjacent a coil-on plug (COP) during the testing of the coil-on plug. The Toyota coil-on plug (P/N 90919-02230HT), shown in more detail in FIG. 1*b*, has an igniter comprising a shielding element 112 disposed on top of the coil-on plug. Shielding element 112 attenuates the electric field emanating from the core 118 of the coil-on plug 110. Since the output field is attenuated, it is advantageous to ensure a close contact between the capacitive sensor (e.g., 315) and the top of the coil-on plug (e.g., 305). Accordingly, it is advantageous to dispose the capacitive sensor within a housing that may be positively attached to either the coil-on plug housing or an adjacent engine component or components to free-up the technicians hands and to minimize misalignment error.

Positive attachment may be achieved by securement devices, such as but not limited to conventional clamps or ties (e.g., tie downs) configured to mate with or attach to portions of the coil-on plug housing, magnetic clips, or a threaded section, if available on the exterior of the coil-on plug housing. In one aspect, a biasing member, such as one or more springs or a foam insert, could be implemented to bias the capacitive sensor 310 against the coil-on plug housing. Further, the capacitive sensor housing could be configured to mate with specific coil-on plug housings. Still further, the capacitive sensor housing could be configured with a plurality of separate capacitive sensors to simultaneously mate with a corresponding plurality of coil-on plug housings, such as taught by U.S. Pat. No. 6,396,277, noted and incorporated by reference above. Moreover, capacitive sensors may be integrated into the COP housing and connected, via the vehicle wiring harness and data links, to an on-board vehicle diagnostic data computer and/or data storage device, for subsequent use by a technician or for display of appropriate messages or signals to a vehicle operator.

The capacitive sensor is, preferably, of the form taught by U.S. Pat. No. 6,396,277, noted above. Such capacitive device is incorporated into a casing or housing having a geometry suitable to facilitate proximal attachment to or placement adjacent a coil-on-plug for measurement. However, conventional types of capacitive sensing elements are also considered to fall within the scope of the disclosure.

As previously noted, the secondary winding generates an electromagnetic field that is primarily an electric field (E). Due to the attenuated electric fields present in some coil-on plug configurations, the firing line and/or the ringing may not be ascertainable. Therefore, the coil-on plug measuring and amplification circuit 300 includes an amplifier 330 to amplify a voltage signal output by the capacitive sensor 315 over wire 320 which, as illustrated, may be shielded.

Figure 4A:
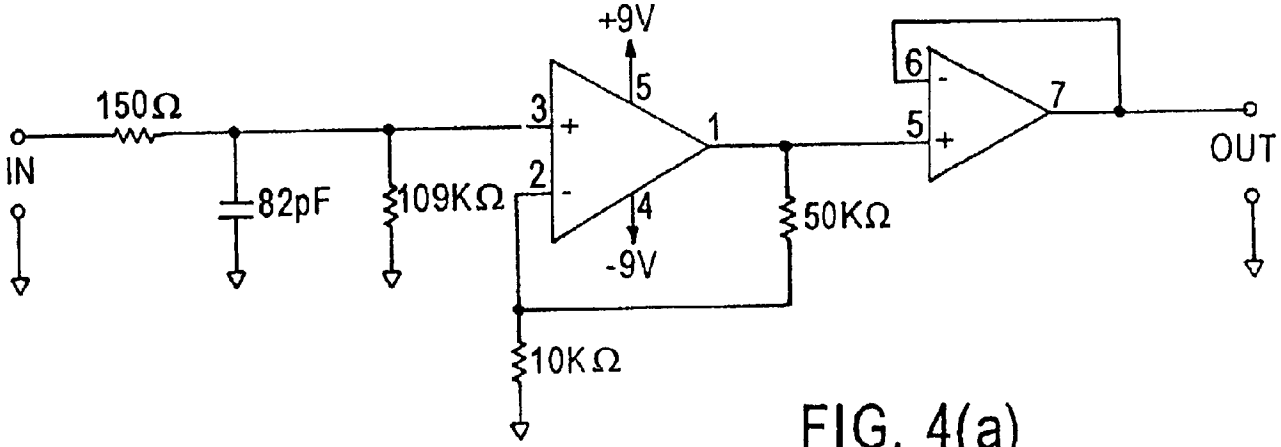
FIGS. 4*a*–4*b* respectively show one aspect of an amplification circuit and one aspect of a voltage changer in accord with the disclosure.
Figure 4B:
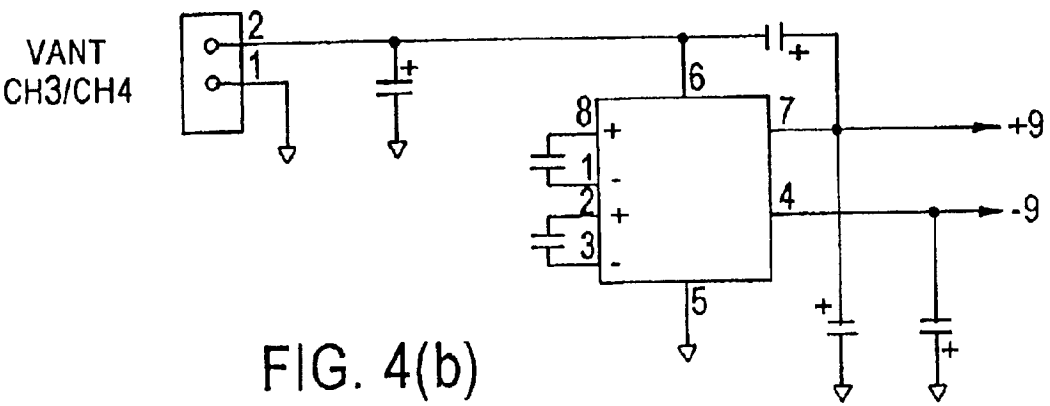

One aspect of a suitable amplifier 330 is shown in FIG. 4(*a*). A low output impedance amplifier 330 is advantageously utilized to drive the high input capactive reactance of the kV Module direct input circuit, as discussed below. Such an exemplary amplifier may include a OP282 dual operational amplifier manufactured by Analog Devices of Norwood, Mass. These amplifiers feature excellent speed at exceptionally low supply currents and, owing to a wide output swing, low power consumption, and high slew rate, are suitable for battery powered systems or power restricted applications. The circuit may optionally utilize an absolute value amplifier (not shown) ahead of or behind the OP282 amplifier to normalize the indicated signal polarity. The operation of amplifier 330 is considered to be well-within the skill of the art and a detailed discussion thereof is accordingly omitted.

The first stage is a non-inverting voltage gain (i.e., 1+50K/10K=6). The 150Ω resistor and 82 pF capacitor cooperatively act as a low-pass noise filter and the 100 KΩ resistor is a DC return. The second stage is a voltage follower having a 100% negative feedback (i.e., $V_{OUT}=V_{IN}$). In this application, it provides a high load resistance for the first stage and delivers an output voltage from a very low source impedance. Thus, the output of amplifier 330 is fed to, in the aspect illustrated in FIGS. 3*a* and 3*b*, a Vantage® kV Module 340 (hereinafter kV Module 340) manufactured by Snap-On Technologies, Inc. through shielded wire 335 and kV Module connector J1.

The kV Module 340 is, in turn, connected to a Vantage® Power Graphing Meter (MT2400) 350 (hereinafter Vantage 350) through an appropriate split connector such as a three-pronged "T" or "Y" connector 355, as shown in FIGS. 3(*a*)–3(*b*). FIG. 3(*b*) depicts, by way of a dashed line, the connection between the Vantage channel ¾ kV Module connector 360 and the kV Module mini-DIN connector 365 and amplifier outlet port 331, as well as the three-way connector 355 which supplies 5V power to amplifier 330 via a power-supply port 332.

FIG. 4(*b*) shows a voltage changer which, in one aspect, includes a pre-packaged IC that acts as a charge pump converter supplying power to the amplifier 330. One such IC chip is the MAX680 chip manufactured by Maxim Integrated Products. This chip delivers approximately [$\pm 2^{*}V_{IN}$], requiring only five 10 uF external electrolytic capacitors to accomplish this. The 5V input from the kV Module is therefore able to deliver the ±9VDC required by amplifier 330. Optionally, the amplifier may be powered by a source including but not limited to AC or DC sources (e.g., one or more batteries) with appropriate regulation in configurations evident to one skilled in the art, obviating the need for a three-way connector. In fact, the voltage changer could be omitted in favor of supplying power to the amplifier 330 through one or more 9V batteries. The operation of the illustrated circuit is considered to be well-within the skill of the art given the level of detail provided and a detailed discussion thereof is accordingly omitted for brevity. Moreover, it is understood that the circuit disclosed herein is capable of significant variation, as known to those skilled in the art, and such variants are deemed encompassed therein.

Figure 5:
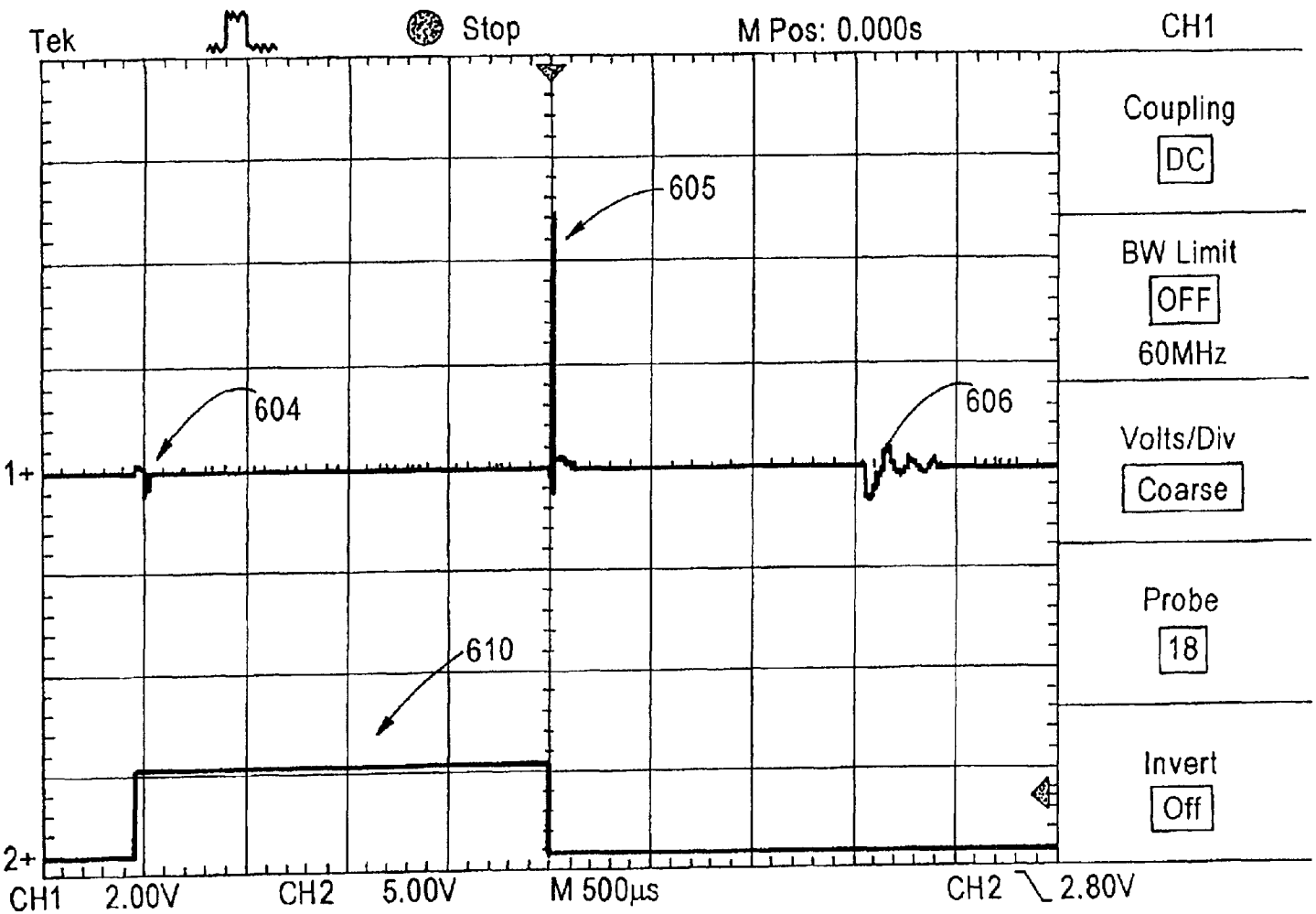
FIG. 5 shows a test result for a shielded coil-on plug measuring and amplification circuit in accord with the disclosure.

FIG. 5 shows a test result implementing another aspect of the above described coil-on plug measuring and amplification circuit 300, showing the voltage across the capacitive sensor 315 as measured using a bench test setup. In the test apparatus, a 0.375" (⅜") metallic disc was placed at the point of maximum output on the top of a coil-on plug (P/N 90919-02230HT) and connected to the kV Module 340 input to provide proper loading and data processing. A lab oscilloscope was tee'd into this connection and used to measure the burn time. A Vantage RPM Probe was used as a trigger source. The RPM Probe responds to both polarities of firing line, whereas the kV Module internal trigger responds only to negative polarity. Thus, the voltage output from the capacitive sensor 315 was measured using two devices. The first device was a Snap-On Vantage kV Module handheld tester and the second device was an attached oscilloscope (e.g., a Tek TDS 220 oscilloscope) having a bandwidth and accuracy greater than that of the handheld tester. Alternatively, the voltage output from the capacitive sensor 315 can optionally be measured by only one measurement device, such as an oscilloscope or a data processing system, to determine the burn time.

Trace or channel 1, having a scale of 2.00V, is the amplified voltage measured by the capacitive sensor 315. As shown at the bottom of the FIG. 5, each block represents an increment of 500.0 μs. The small negative spike 604 of Trace 1 (−0.5 Vp) on the left of chart, is the beginning of the coil charging and corresponds to the beginning of the dwell section, shown in Trace 2. The positive spike 605 of trace 1 in the middle of the chart (+5 Vp) is the firing line, which signifies the start of burn time and the end of the dwell section. The small positive spike 606 on right of Trace 1 (+0.4 Vp) is the end of burn time. The burn time may be extracted from the waveform based on observation of known behaviors of the coil-on plug system, described generally in relation to FIGS. 2*a* and 2*b*, by a technician or a data processing system in a manner known to those skilled in the art. Here, the burn time is determined by measuring the time from the firing line 605, an obvious event on the viewing or printing device attached to the capacitive sensor 310, to the start of the oscillations or ringing 606 occurring roughly one or more milliseconds later. The burn time on Trace 1 is approximately 1.65 ms. The corresponding value measured by the Tek HV probe (not shown) was 2.25 ms.

Trace 2, having a scale of 5V, simulates the auto computer to drive the COP internal igniter by connecting the low side of the primary to ground during the dwell section. The igniter requires a +5 Vp pulse 610, 2 ms long to accomplish charging the coil core to near flux saturation. The auto computer accumulates information from a variety of engine sensors to establish correct engine timing. That timing signal starts the dwell period of 2 ms by delivering a pulse 610 such as shown by trace 2. Therefore, the computer "knows" that 2 ms after the start of the dwell section, a firing line will be generated and that the proper spark plug will fire.

Although the data agreement between the scope and the Vantage 350 is not optimal in this instance (i.e., 1.65 ms vs. 2.25 ms), it is the cylinder to cylinder readings which confer the primary diagnostic benefit. In other words, the diagnostic value does not lie in exclusively in providing an exact value of bum time. The diagnostic value also inheres in, for example, relative firing line magnitudes or burn times between each of a plurality of coil-on plugs to determine differences therebetween. For example, if a technician places a capacitive sampling sensor, using the disclosed amplification techniques, over a plurality of coil-on plugs and all but one of the coil-on plugs has a substantially equivalent burn time and one coil-on plug has an outlier reading, then it is probable that the outlier indicates a problem in need of further evaluation.

Although the disclosed coil-on plug measuring and amplification circuit 300 is described in relation to a particular shielded coil-on plug, the principals embodied therein can be broadly applied, to other vehicles, engines, and coil-on plug arrangements. Any minor modifications required to adapt the disclosed concepts and circuit to another vehicle, engine, or coil-on plug arrangement is considered to be well-within the skill of the art.

Further, the disclosed coil-on plug measuring and amplification circuit 300 may be advantageously implemented as a switchable configuration, wherein a capacitive sensor can be wedded to single measurement device (not shown) comprising a plurality of selectable or variable circuits to permit a technician to use a single sensor or sensing unit across a broad range of vehicles within a family of vehicles, such as Toyota vehicles, or across a broad range of engine types or shielded coil-on-plug architectures. For example, a single measurement device could include a first amplification circuit for a first shielded coil-on plug (or related family of coil-on plug), a second amplification circuit for a second shielded coil-on plug (or related family of coil-on plug), and a third amplification circuit for a third shielded coil-on plug (or related family of coil-on plug). The first, second, and third shielded coil-on plugs, or related families, could be disposed on the same make of vehicle or on different vehicle makes or types. Selection of an appropriate coil or family can be achieved by a switching means, considered well-known within the art. Any number of separate circuits may be employed in such a measuring device. Further, a plurality of circuits may be multiplexed to a plurality of capacitive sensors to permit an even greater range of applicability within a convenient package.

Although the above circuits are described in relation to particular manufacturers and automobile models, the actual circuits relate more particularly to specific coil types and geometries. Thus, the teachings herein are not limited to providing diagnostic information for particular makes and models, or even of specific vehicle types, but of providing useful diagnostic information for coil-on plug systems used in any engine or vehicle type.

The implementation is by no means limited to the above described circuits, but comprises, broadly, any circuit able to amplify a voltage produced by a capacitive sensor (e.g. 315) disposed over a shielded coil-on plug in a form suitable for identification of ignition event indicators, such as described above, whether by a technician or by a processing device (i.e., a computer). Particularly advantageous is a circuit and apparatus configured to permit a technician or computer to identify both the occurrence of a firing line and an endpoint of a spark line to permit determination of a burn time by comparing or integrating the time between the firing line and the endpoint of the spark line. In various forms, the implementation may comprise a circuit having "universal" components wherein a single circuit is adaptable for use with a large number (e.g., 100 or more) of different coil-on plugs. For example, such a circuit could advantageously comprise scalable and or selectable components that could cover, individually or in combination, a desired range of performance encompassing a desired number of different coil-on plug designs. Alternatively, to the extent desirable, a circuit in accord with the disclosure may comprise a plurality of "semi-universal" circuits with appropriate selection means, wherein a plurality of variable circuits are provided to cover a plurality of ranges which, together, encompass an entire range of coil-on plug designs.

The embodiments described herein may include or be utilized with any appropriate voltage source, such as a battery, an alternator and the like, providing any appropriate voltage, such as about 12 Volts, about 42 Volts and the like.

The embodiments described herein may be used with any desired ignition system or engine. Those systems or engines may comprises items utilizing organically-derived fuels or fossil fuels and derivatives thereof, such as gasoline, natural gas, propane and the like or combinations thereof. Those systems or engines may be utilized with or incorporated into another systems, such as an automobile, a truck, a boat or ship, a motorcycle, a generator, an airplane and the like.

Various aspects of the invention have been discussed in the present disclosure to illustrate its versatility. It is to be understood that the invention is capable of use in various other combinations and environments and is capable of changes or modifications within the scope of the inventive concepts expressed herein. Moreover, although illustrative examples of the apparatus and method were discussed, the invention is not limited by the examples provided herein and additional variations of the invention are embraced by the claims appended hereto.

What is claimed:

1. A coil-on plug testing apparatus for detecting a weak field output by a shielded coil-on plug ignition and generating an output signal representing an ignition signal, comprising:

a capacitive sensor for detecting an electric field generated by the shielded coil-on plug device during a firing event and generating and outputting a voltage in response thereto;

a signal processing circuit electrically coupled to the capacitive sensor for generating an output signal in response to variations in the voltage output by the capacitive sensor in response to a detected electric field, wherein the signal processing circuit comprises an amplifier configured to amplify an output voltage of the capacitive sensor.

2. The coil-on plug testing apparatus according to claim 1, wherein the amplifier comprises a dual operational amplifier.

3. A coil-on plug testing apparatus for detecting a weak field output by a shielded coil-on plug ignition and generating an output signal representing an ignition signal, comprising:

a capacitive sensor for detecting an electric field generated by the shielded coil-on plug device during a firing event and generating and outputting a voltage in response thereto;

a signal processing circuit electrically coupled to the capacitive sensor for generating an output signal in response to variations in the voltage output by the capacitive sensor in response to a detected electric field, wherein the signal processing circuit comprises an amplifier configured to amplify an output voltage of the capacitive sensor, wherein the amplifier comprises a dual operational amplifier, wherein the dual operational amplifier is a low output impedance amplifier.

4. The coil-on plug testing apparatus according to claim 3, wherein the signal processing circuit further comprises a voltage changer.

5. The coil-on plug testing apparatus according to claim 4, wherein the voltage changer acts as a charge pump converter.

6. A coil-on plug testing apparatus for detecting a weak field output by a shielded coil-on plug ignition and generating an output signal representing an ignition signal, comprising:

a capacitive sensor for detecting an electric field generated by the shielded coil-on plug device during a firing event and generating and outputting a voltage in response thereto;

a signal processing circuit electrically coupled to the capacitive sensor for generating an output signal in response to variations in the voltage output by the capacitive sensor in response to a detected electric field, wherein the signal processing circuit comprises an amplifier configured to amplify an output voltage of the capacitive sensor, further comprising:

at least one of a switch and a multiplexer; and a plurality of signal processing circuits configured to be selectively electrically coupled to the capacitive sensor through the switch or multiplexer, wherein the signal processing circuits each generate an output signal in response to variations in the voltage output by the capacitive sensor in response to a detected electric field, and wherein each of the signal processing circuits comprises an amplifier configured to amplify an output voltage of the capacitive sensor.

7. The coil-on plug testing apparatus according to claim 4, further comprising:

at least one of a switch and a multiplexer; and a plurality of signal processing circuits configured to be selectively electrically coupled to the capacitive sensor through the switch or multiplexer, wherein the signal processing circuits each generate an output signal in response to variations in the voltage output by the capacitive sensor in response to a detected electric field, and wherein each of the signal processing circuits comprises an amplifier configured to amplify an output voltage of the capacitive sensor.

8. The coil-on plug testing apparatus according to claim 1, wherein the capacitive sensor is configured to be attached adjacent the coil-on-plug device.

9. The coil-on plug testing apparatus according to claim 1, wherein the capacitive sensor is configured to be attached to a coil-on-plug device housing.

10. The coil-on plug testing apparatus according to claim 1, wherein the capacitive sensor comprises a plurality of sensors configured to be simultaneously attachable to a corresponding plurality of coil-on-plug devices for detecting an electric field generated by the shielded coil-on plug devices during a firing event and generating and outputting voltages in response thereto.

11. A method for measuring an output from a shielded coil-on plug ignition, comprising the steps of:

disposing a capacitive sensor adjacent a shielded coil-on plug ignition housing;

detecting an electric field output by the shielded coil-on plug ignition during a period encompassing at least one firing section using the capacitive sensor;

amplifying the detected electric field; and outputting the amplified signal to an output device.

12. A method for measuring an output from a shielded coil-on plug ignition according to claim 11, wherein the step of disposing the capacitive sensor includes disposing the capacitive sensor adjacent a top of the shielded coil-on plug ignition housing.

13. A method for measuring an output from a shielded coil-on plug ignition according to claim 12, wherein the disposing step comprises removably attaching the capacitive sensor to an exterior of the shielded coil-on plug ignition housing.

14. A method for measuring an output from a shielded coil-on plug ignition according to claim 12, further comprising determining a burn time by identifying a firing line equivalent, identifying an endpoint of a spark line, and determining the time between the firing line and the endpoint of the spark line.

15. A method for measuring an output from a shielded coil-on plug ignition according to claim 12, wherein the outputting step comprises outputting the amplified signal to at least one of a display device, a printing device, and an indicating device.

16. A method for detecting problems associated with a coil-on plug ignition, comprising the steps of:

a) disposing a capacitive sensor adjacent a first shielded coil-on plug housing;

b) using the capacitive sensor to detect an electric field output by the shielded coil-on plug ignition during a period encompassing at least one firing section;

c) identifying at least one of a firing line equivalent and burn time;

d) repeating steps a)–c) for a second shielded coil-on plug; and e) comparing at least one of a corresponding firing line equivalent and burn time identified with respect to the first and second shielded coil-on plugs to determine a relative difference therebetween.

17. A method for detecting problems associated with a shielded coil-on plug ignition according to claim 16, wherein step e) comprises comparing a burn time identified with respect to the first and second shielded coil-on plugs to determine a relative difference therebetween.

18. A method for detecting problems associated with a shielded coil-on plug ignition, comprising the steps of:

a) disposing a sensor adjacent a first shielded coil-on plug housing;

b) using the sensor to detect electromagnetic radiation emitted by the shielded coil-on plug ignition during a period encompassing at least one firing section;

c) identifying at least one of a firing line equivalent and burn time;

d) repeating steps a)–c) for a second shielded coil-on plug; and e) comparing at least one of a corresponding firing line equivalent and burn time identified with respect to the first and second shielded coil-on plugs to determine a relative difference therebetween.

19. A method for detecting problems with a shielded coil-on plug ignition according to claim 18, wherein step e) comprises comparing a burn time identified with respect to the first and second shielded coil-on plugs to determine a relative difference therebetween.

* * * * *